US009212450B2

(12) United States Patent
Grunert et al.

(10) Patent No.: US 9,212,450 B2
(45) Date of Patent: Dec. 15, 2015

(54) CONDENSATION DRYER COMPRISING A HEAT PUMP AND METHOD FOR OPERATING THE SAME

(75) Inventors: Klaus Grunert, Berlin (DE); Günter Steffens, Dallgow-Döberitz (DE); Andreas Stolze, Falkensee (DE)

(73) Assignee: BSH Hausgeraete GmbH, Munich (DE)

( * ) Notice: Subject to any disclaimer, the term of this patent is extended or adjusted under 35 U.S.C. 154(b) by 1524 days.

(21) Appl. No.: 12/522,067

(22) PCT Filed: Dec. 19, 2007

(86) PCT No.: PCT/EP2007/064180

§ 371 (c)(1),
(2), (4) Date: Jul. 2, 2009

(87) PCT Pub. No.: WO2008/086933

PCT Pub. Date: Jul. 24, 2008

(65) Prior Publication Data

US 2010/0083527 A1 Apr. 8, 2010

(30) Foreign Application Priority Data

Jan. 15, 2007 (DE) ..... 10 2007 002 181

(51) Int. Cl.
*D06F 58/20* (2006.01)

(52) U.S. Cl.
CPC ..... *D06F 58/20* (2013.01); *D06F 58/206* (2013.01)

(58) Field of Classification Search
CPC ..... D06F 58/20; D06F 58/206
USPC ..... 34/467, 468, 72, 73, 74, 76, 77, 78, 86, 34/134, 218, 219; 62/79
See application file for complete search history.

(56) References Cited

U.S. PATENT DOCUMENTS

| | | | | |
|---|---|---|---|---|
| 4,603,489 | A * | 8/1986 | Goldberg | 34/77 |
| 7,975,502 | B2 * | 7/2011 | Tamura et al. | 62/324.1 |
| 2005/0066538 | A1 * | 3/2005 | Goldberg et al. | 34/218 |
| 2006/0048404 | A1 * | 3/2006 | Tadano et al. | 34/134 |

FOREIGN PATENT DOCUMENTS

| | | | |
|---|---|---|---|
| DE | 4216106 | A1 | 11/1993 |
| DE | 20101641 | U1 | 7/2002 |
| DE | 4023000 | C2 | 2/2003 |
| DE | 19738735 | C2 | 2/2003 |
| DE | 102005062940 | A1 | 7/2007 |
| EP | 1884586 | A2 | 2/2008 |
| JP | 200527733 | A | 2/2005 |

* cited by examiner

*Primary Examiner* — Jiping Lu
(74) *Attorney, Agent, or Firm* — James E. Howard; Andre Pallapies

(57) ABSTRACT

A condensation dryer is provided that includes a drying chamber for articles to be dried and a process air circuit in which a heater for heating the process air is located. The heated process air can be guided across the articles to be dried along a circulation route that includes a blower, an air/air heat exchanger, and a heat pump circuit having an evaporator, a compressor and a condenser. An additional heat exchanger is arranged in the heat pump circuit between the condenser and the evaporator, the additional heat exchanger being functionally coupled to the air/air heat exchanger.

9 Claims, 5 Drawing Sheets

CONDENSATION DRYER COMPRISING A HEAT PUMP AND METHOD FOR OPERATING THE SAME

BACKGROUND OF THE INVENTION

The invention relates to a condensation dryer comprising a drying chamber for the articles to be dried, a process air circuit in which a heater for heating the process air is located and wherein the heated process air can be guided across the articles to be dried by means of a blower, an air/air heat exchanger and a heat pump circuit comprising an evaporator, a compressor and a condenser, and a method for operating same.

Tumble dryers, whose mode of operation is based on the condensation of the moisture evaporated from the washing by means of warm process air from the process air discharged from the washing—so-called condensation dryers—do not require a hose for discharging the process air charged with moisture and are very popular because they can be used in internal bathrooms or utility rooms of larger housing complexes. This applies both to tumble dryers intended specifically for drying washing and also to so-called washer dryers, that is to say appliances which are able to both wash and also dry washing. Each and any subsequent reference to a "tumble dryers" or "condensation dryer" therefore applies both to an appliance intended only for drying and also to an appliance intended equally for washing and drying.

In a condensation dryer, air (so-called process air) is directed by a blower by way of a heater into a drum containing moist items of washing as a drying chamber. The hot air takes up moisture from the items of washing to be dried. After passing through the drum, the now moist process air is directed into a heat exchanger, which usually has a lint filter connected upstream.

In the heat exchanger the moist process air is cooled, for example by means of a separately guided cooling air current, such that the moisture contained in the process air condenses as water. The condensed water is then as a general rule collected in a suitable container for subsequent disposal and the cooled and dried air is delivered again to the heater and then to the drum.

This drying operation is energy intensive because the heat extracted during the cooling of the process air in the heat exchanger is lost to the process in terms of energy efficiency, in any case in the situation when this heat is discharged in a cooling air current. This loss of energy can be significantly reduced through the use of a heat pump. In the case of a condensation dryer equipped with a heat pump the cooling of the warm process air charged with moisture takes place essentially in a first heat exchanger of the heat pump, in particular an evaporator, where the transferred heat is used in order to evaporate a cooling agent employed in the heat pump. Such cooling agent evaporated as a result of the heating is delivered by way of a compressor to a second heat exchanger, in the given case and subsequently also referred to as "condenser", of the heat pump, where as a result of the condensation of the gaseous cooling agent heat is released which in turn is used for heating the process air prior to its entry into the drum. The liquefied cooling agent passes through a control valve, which reduces its pressure, back to the evaporator in order to evaporate there whilst taking up heat again from the process air.

A tumble dryers comprising a heat pump is described in DE 40 23 000 C2, in which tumble dryer an inlet air opening which can be closed by means of a controllable closure device is arranged in the process air duct between the condenser and the evaporator.

A condensation dryer comprising a closed process air circuit is described in DE 197 38 735 C2, which condensation dryer is equipped with a heat pump. The heat pump is designed as a device operating in accordance with the absorber principle, the absorber of which device forms a third heat exchanger whose primary circuit has cooling agent flowing through it, and through whose secondary circuit the process air flowing away from the second heat exchanger is fed once again to the secondary circuit of the first heat exchanger.

The air/air heat exchanger customarily used—operated in crossing mode or in opposite stream mode—and the electrical heater are in general replaced completely by a heat pump. By this means, improvements in energy performance of 20 to 50% can be achieved.

Compressor units as described above are used as popular heat pumps. As a rule these operate optimally in a particular temperature range. Problematical regarding the use of a compressor heat pump in the condensation dryer are the mostly high temperatures in the condenser which for process-related reasons result in the fact that the compressor needs to be switched off and/or that the level of efficiency of the heat pump deteriorates. This problem is all the worse if the compressor is supported by an additional heater in the process air circuit in order to achieve a faster and/or greater heating of the process air and thus shorter drying times. A means for monitoring and/or reducing the cooling agent temperatures in the heat pump circuit is therefore desirable.

In order to eliminate this problem, the compressor can for example be cooled by means of an additional fan. Furthermore, the cooling agent can be additionally cooled after the condenser by using an additional heat exchanger which is equipped with an additional blower. These solutions have the disadvantage that additional resource deployment, in particular an additional blower, is required.

BRIEF SUMMARY OF THE INVENTION

One object of the invention is therefore to provide a condensation dryer of the type described in the introduction, in which an optimum cooling agent temperature can be easily set. In particular, a condensation dryer should be provided which makes it possible to reduce the cooling agent temperature in the condenser. A method for operating such a condensation dryer should also be specified.

This object is achieved according to the invention by a condensation dryer and a method.

Preferred embodiments of the method analogously correspond to preferred embodiments of the condensation dryer.

The subject matter of the invention is thus a condensation dryer comprising a drying chamber for the articles to be dried, items of washing as a general rule, a process air circuit, in which a heater for heating the process air is located and wherein the heated process air can be guided across the articles to be dried by means of a blower, an air/air heat exchanger and a heat pump circuit comprising an evaporator, a compressor and a condenser, an additional heat exchanger being arranged in the heat pump circuit between the condenser and the evaporator, said additional heat exchanger being functionally coupled with the air/air heat exchanger.

According to the invention, an additional heat exchanger is integrated into the condensation dryer equipped as a "hybrid" both with a heat pump circuit and also with an air/air heat exchanger. In this situation, the invention is based on the knowledge that the air/air heat exchanger and in particular the ducts connected to the latter for process air or cooling air offer sufficient heat sinks in order to be able to dissipate any possible surplus of heat from the heat pump circuit without an adverse effect on the drying process, whereby this surplus does not necessarily need to be lost in its entirety or for the most part.

In a preferred embodiment of the condensation dryer according to the invention the additional heat exchanger is arranged in a process air duct between the evaporator and the condenser. By particular preference in this situation, the additional heat exchanger is arranged between the condenser and a relief valve, by means of which the internal pressure of the liquefied cooling agent is reduced to a lower level so that liquefied cooling agent is subsequently able to evaporate in the evaporator. In this situation, the exchange of heat takes place in the additional heat exchanger between the liquid cooling agent and the relatively cool process air. In this configuration, the additional heat exchanger is not simply an extension of the condenser. In the condenser, the cooling agent is present partly in the liquid phase and partly in the gaseous phase, for which reason a temperature is reached in the condenser which corresponds to the boiling temperature of the cooling agent at the given pressure in the condenser. A temperature lower than this cannot be achieved in the condenser, not even if the condenser is made structurally larger. However, if the liquid cooling agent is extracted pure from the two-phase mixture, then its temperature can be lowered if required by means of a further heat exchange. This measure is known by the term "subcooling". Precisely this happens in the additional heat exchanger, which for this reason cannot be regarded as part of the condenser, even if it is located in very close proximity to the condenser.

In another preferred embodiment of the condensation dryer according to the invention the additional heat exchanger is located in a cooling air duct of the air/air heat exchanger.

In consequence of its function as a heat exchanger, the additional heat exchanger is located as a general rule in two ducts, whereby according to the invention one of these ducts is the heat pump circuit and the other duct is the cooling air duct or the process air duct.

In the condensation dryer according to the invention, more than one additional heat exchanger can be present in the heat pump circuit. For example, a first additional heat exchanger can be located in the process air duct and a second additional heat exchanger can be located in the cooling air duct.

If an additional heat exchanger is located in the cooling air duct, in a first preferred embodiment it is arranged between a cooling blower and the air/air heat exchanger.

In a second preferred embodiment, the additional heat exchanger is arranged in the cooling air duct on the side of the air/air heat exchanger facing away from a cooling blower.

In a third preferred embodiment, the additional heat exchanger is arranged in the cooling air duct on the side of a cooling blower facing away from the air/air heat exchanger.

The cooling agent used in the heat pump circuit is preferably selected from the group which consists of a butane/isopropane mixture, carbon dioxide and a chlorofluorocarbon compound.

In a preferred embodiment of the condensation dryer, the air/air heat exchanger is removable. This is particularly advantageous because a removable heat exchanger can be more easily cleaned of lint.

The invention also relates to a method for operating a condensation dryer just described, in which process air is guided by means of a blower in a process air circuit, whereby the heat exchange between the heat pump and the process air circuit is supported by the additional heat exchanger between the condenser and the evaporator.

Preferred embodiments of the method according to the invention correspond to preferred embodiments of the condensation dryer according to the invention, and vice versa, even if nothing is alluded to in detail for the given situation in the present case.

In addition to evaporator, condenser and compressor, the heat pump in the condensation dryer according to the invention has a relief valve (also referred to as throttle valve or flow control valve) between the condenser and the evaporator in the direction of flow of the cooling agent.

The cooling agent used in the heat pump preferably circulates in the heat pump circuit with a turbulent flow. A turbulent flow can be set up by means of a suitable design configuration for the flow duct and/or by means of suitable drive facilities (compressor, for example).

According to the invention, the temperature of the cooling agent of the heat pump, in particular in the condenser, is maintained in the permitted range as a general rule through control of heat pump and additional heat exchanger. Since in the case of the condensation dryer according to the invention a heater is located in the process air circuit prior to the entry into the drying chamber, control of the heat pump is preferably carried out in coordination with control of the heater.

According to the invention, it is preferred if process air and cooling air or process air and cooling agent in the heat pump are guided in a crossing mode or opposite stream mode through the corresponding heat exchangers for the given situation.

According to the invention, an improved capability to set the temperature of the cooling agent in the heat pump, in particular in the condenser, is given by the combination of a heat pump with the additional heat exchanger and with an air/air heat exchanger. In this connection, the hot process air charged with moisture after passing through a drying chamber (washing drum) is first cooled in an air/air heat exchanger, where it can deposit moisture in the form of condensed water. Then the already somewhat cooled process air is fed to the evaporator of the heat pump circuit where the process air is additionally cooled. As a result of the use of the air/air heat exchanger located upstream of the heat pump in the process air circuit, the cooling agent of the heat pump is less strongly heated.

The heater used in the condensation dryer according to the invention is preferably a two-stage heater. In a preferred embodiment of the invention, the control of this heater is likewise employed for regulating the temperature of the cooling agent.

Since with an advancing degree of dryness of the articles to be dried in the condensation dryer the energy required for the drying decreases, it is advantageous to regulate the heater accordingly, in other words to reduce the heat output of the heater as the degree of dryness advances in order to maintain a balance between the drying energy fed and the drying energy required.

With an advancing degree of dryness of the articles to be dried, in particular washing, a lower heat output or even an increasing cooling capacity of the heat pump thus becomes necessary. In particular, the temperature in the process air circuit would rise sharply after completion of a drying phase. In general therefore the heat pump and the heater in condensation dryer are regulated such that a maximum permissible temperature is not exceeded in the drying chamber.

In order to regulate the temperature of cooling agent or heat pump and also the temperature of the process air, in general temperature sensors already known to the person skilled in the art are used in the heat pump circuit and/or in the process air circuit.

The invention has the advantage that the temperature of the cooling agent in the heat pump can be easily regulated. In particular, the temperature of the cooling agent can be regulated such that the heat pump and in particular the condenser operate in an optimum temperature range. This enables the condensation dryer to operate with a more favorable energy balance. It serves furthermore to conserve the heat pump. Moreover, the demands on the compressor of the heat pump can be lessened at a lower cooling agent temperature.

BRIEF DESCRIPTION OF THE DRAWINGS

Further details of the invention are set down in the description which follows of non-limiting exemplary embodiments of the condensation dryer according to the invention and a method to be used in this condensation dryer. In this situation reference is made to the FIGS. 1 to 5.

DETAILED DESCRIPTION OF EXEMPLARY EMBODIMENTS OF THE PRESENT INVENTION

Figure 1:
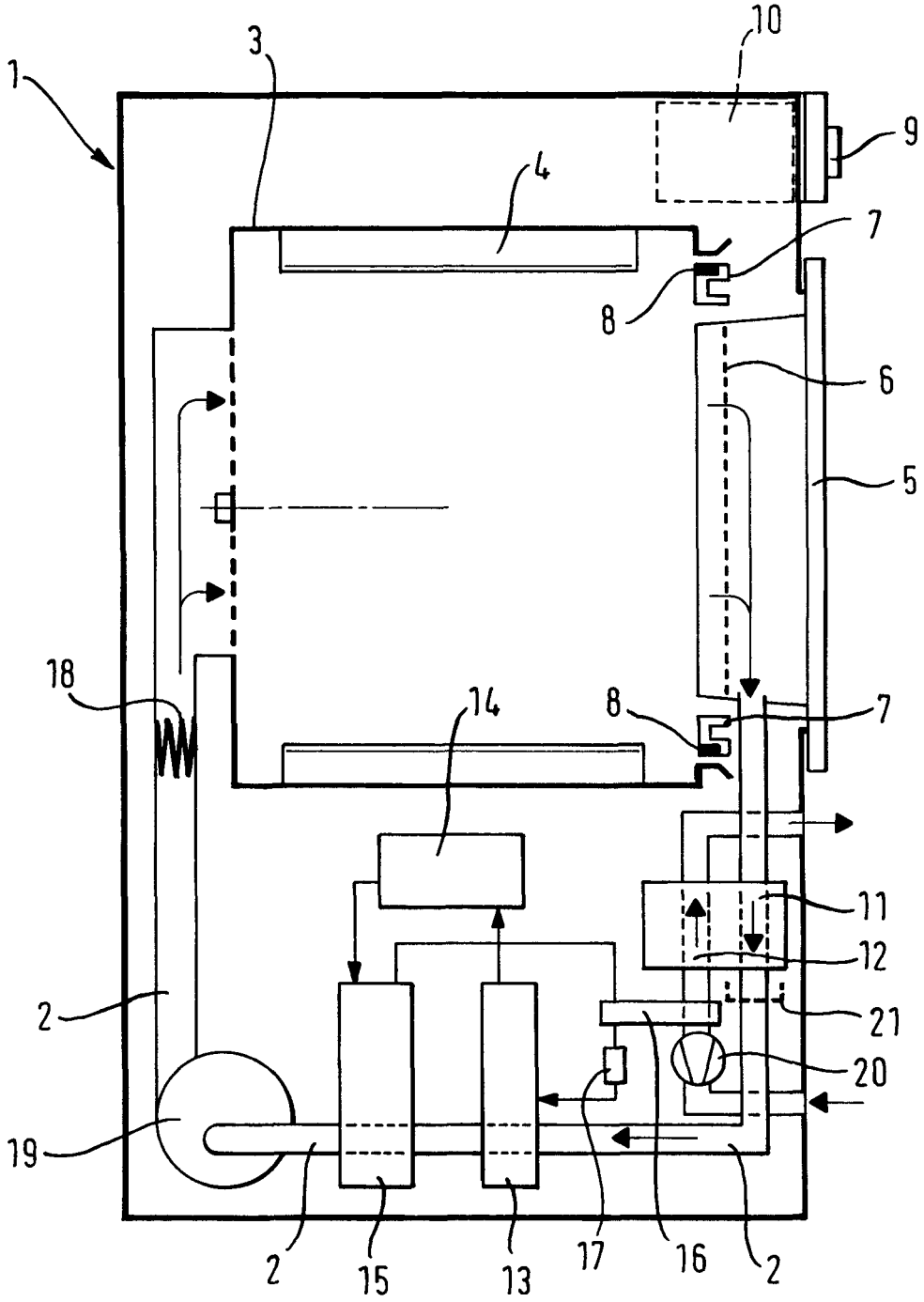
FIG. 1 shows a vertical section through a condensation dryer.

FIG. 1 shows a vertical section through a condensation dryer 1 (abbreviated to "dryer" in the following) in which an additional heat exchanger 16 is located both in the heat pump circuit 13, 14, 15, 16, 17 and also in the cooling air duct 12 of an air/air heat exchanger 11, 12. This additional heat exchanger 16 is thus coupled functionally with the air/air heat exchanger 11, 12.

The dryer 1 represented in FIG. 1 has a drum capable of rotating around a horizontal axis as a drying chamber 3, inside which are fitted paddles 4 for moving washing while the drum is rotating. Process air is guided by means of a blower 19 by way of a heater 18, through a drum 3, an air/air heat exchanger 11, 12 and also a heat pump 13, 14, 15 in an air duct 2 in a closed circuit (process air circuit 2). After passing through the drum 3, the moist warm process air is cooled and, following condensation of the moisture contained in the process air, heated again. In this situation, air heated by the heater 18 is directed from the rear, in other words from the side of the drum 3 located opposite a dryer door 5, into the drum 3 through the latter's perforated base, where it comes into contact with the washing to be dried and flows through the filler opening of the drum 3 to a lint filter 6 inside a dryer door 5 which seals the filler opening. The air flow in the dryer door 5 is then deflected downwards and directed by the air duct 2 to the air/air heat exchanger 11, 12. There, as a result of cooling, the moisture taken up by the process air from the items of washing condenses and is collected in a condensate container 21 drawn in dashed lines in FIG. 1, whence it can be disposed of. The somewhat cooled process air is then guided to the evaporator 13 of a heat pump 13, 14, 15 where it is cooled further. The cooling agent of the heat pump having evaporated in this situation in the evaporator 13 is directed by way of a compressor 14 to the condenser 15. In the condenser 15, the cooling agent liquefies whilst dissipating heat to the process air. The cooling agent now present in liquid form is then guided to an additional heat exchanger 16 which is located in the cooling air duct 12 of the air/air heat exchanger 11, 12 between the latter and a cooling (air) blower 20, and in turn is guided from there by way of a throttle valve 17 to the evaporator 13, as a result of which the cooling agent circuit is closed. The cooling air is taken from the ambient air and, after passing through the air/air heat exchanger 11, 12, is returned to the ambient air.

In the embodiment shown in FIG. 1 the drum 3 is mounted at the rear of the base by means of a rotary bearing and at the front by means of a bearing bracket 7, whereby the drum 3 is located with a brim on a glide strip 8 at the bearing bracket 7 and is held in this way at the front end. The control of the condensation dryer is effected by way of a control device 10 which can be regulated by the user by means of an operating panel 9.

Figure 2:
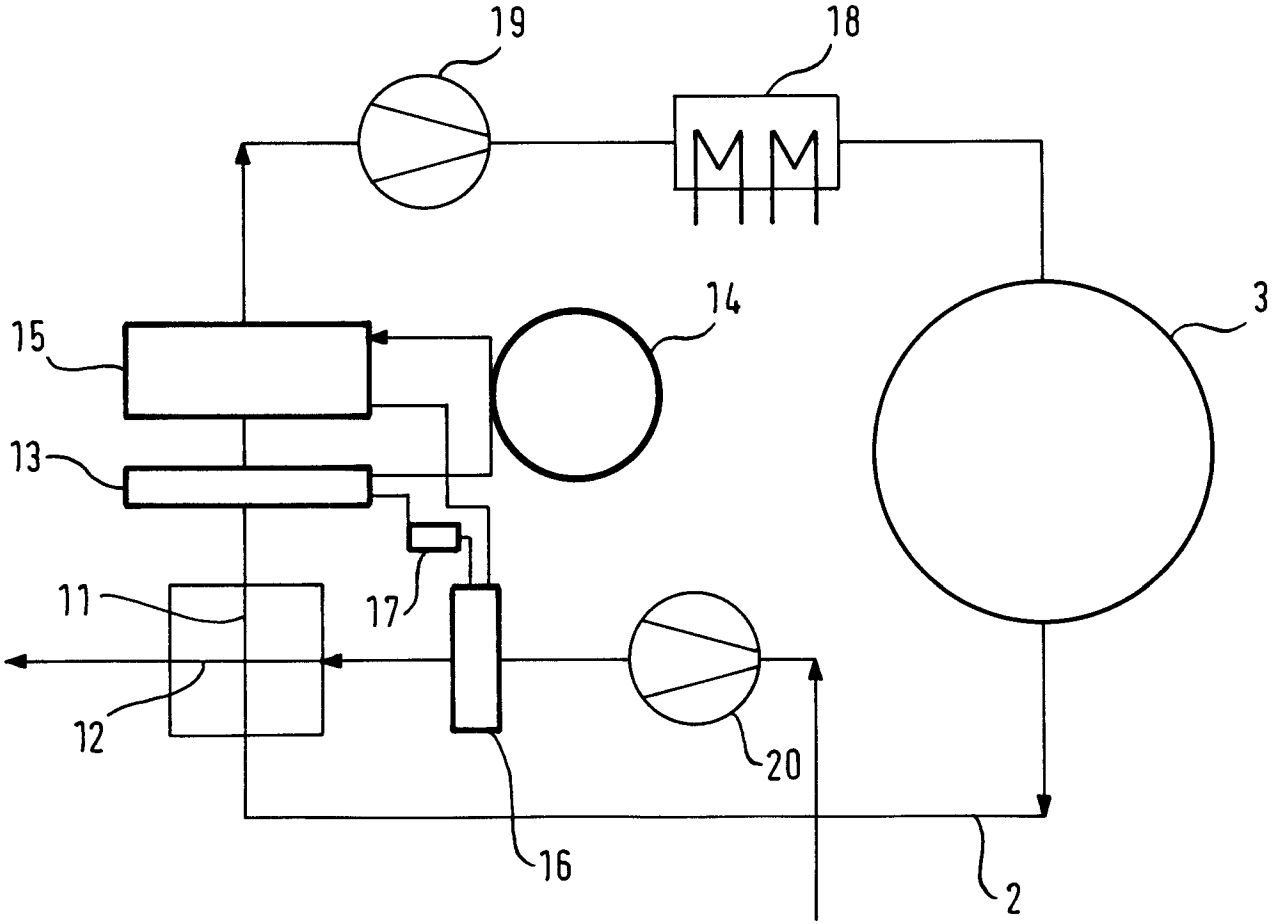
FIG. 2 shows a schematic representation of the process air circuit and of the heat pump circuit for the embodiment of a condensation dryer shown in FIG. 1.

FIG. 2 shows a schematic representation of the process air circuit and of the heat pump circuit for the embodiment of a condensation dryer shown in FIG. 1. While the process air in the closed process air circuit 2 and the cooling agent in the closed heat pump circuit are being guided to the heat pump 13, 14, 15, the air used for cooling in the air/air heat exchanger 11, 12 is taken from the ambient air, directed by way of the cooling blower 20 after passing through the additional heat exchanger 16 to the air/air heat exchanger 11, 12 and then fed again to the ambient air.

Figure 3:
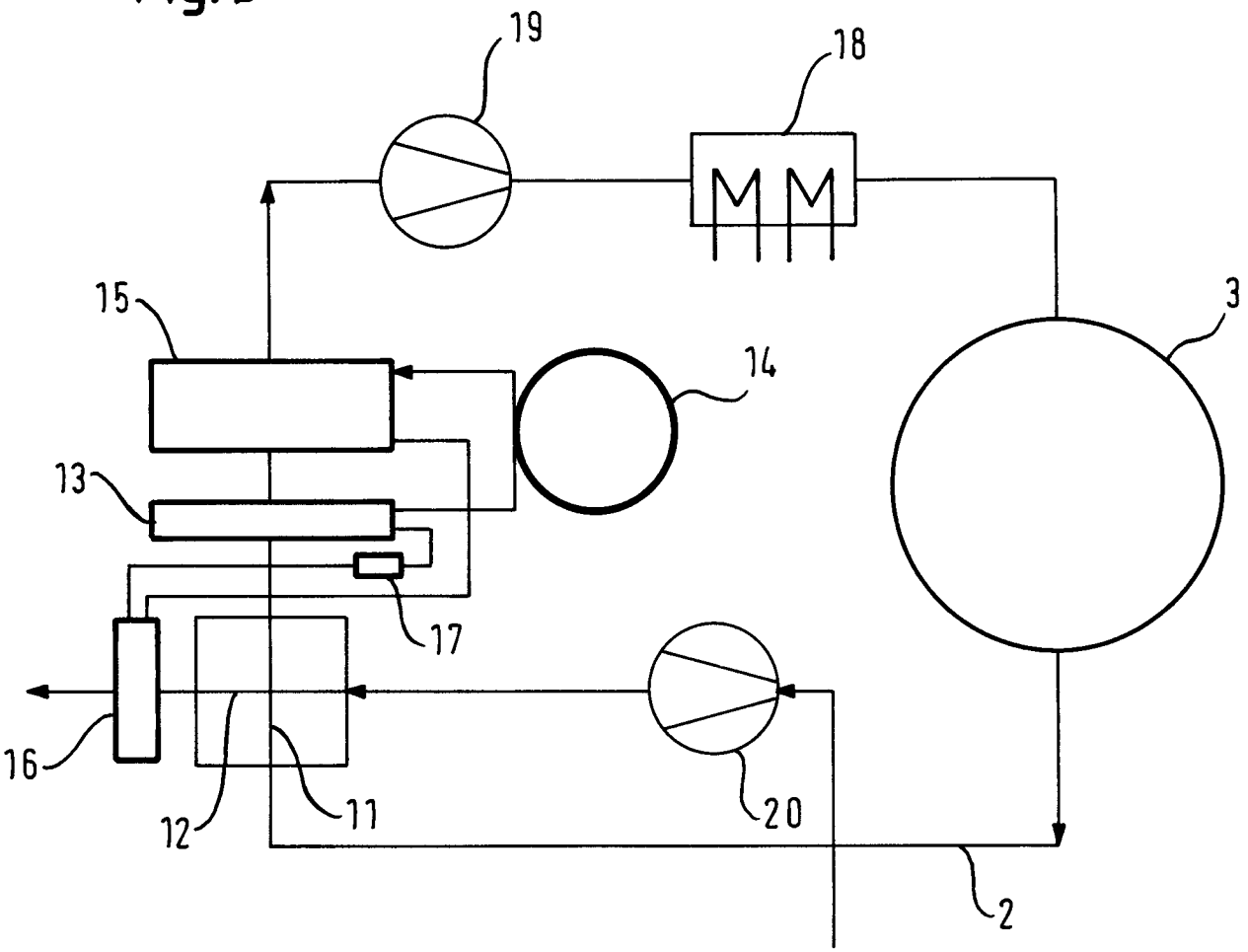
FIG. 3 shows a schematic representation of the process air circuit and of the heat pump circuit for a second embodiment of the condensation dryer.

FIG. 3 shows a schematic representation of the process air circuit and of the heat pump circuit for a second embodiment of the condensation dryer with an additional heat exchanger 16 which is functionally coupled with the air/air heat exchanger 11, 12. With regard to this second embodiment, the additional heat exchanger 16 is likewise located in the cooling air duct 12 of the air/air heat exchanger 11, 12, albeit in the cooling air duct 12 on the side of the air/air heat exchanger 11, 12 facing away from the cooling blower 20.

Figure 4:
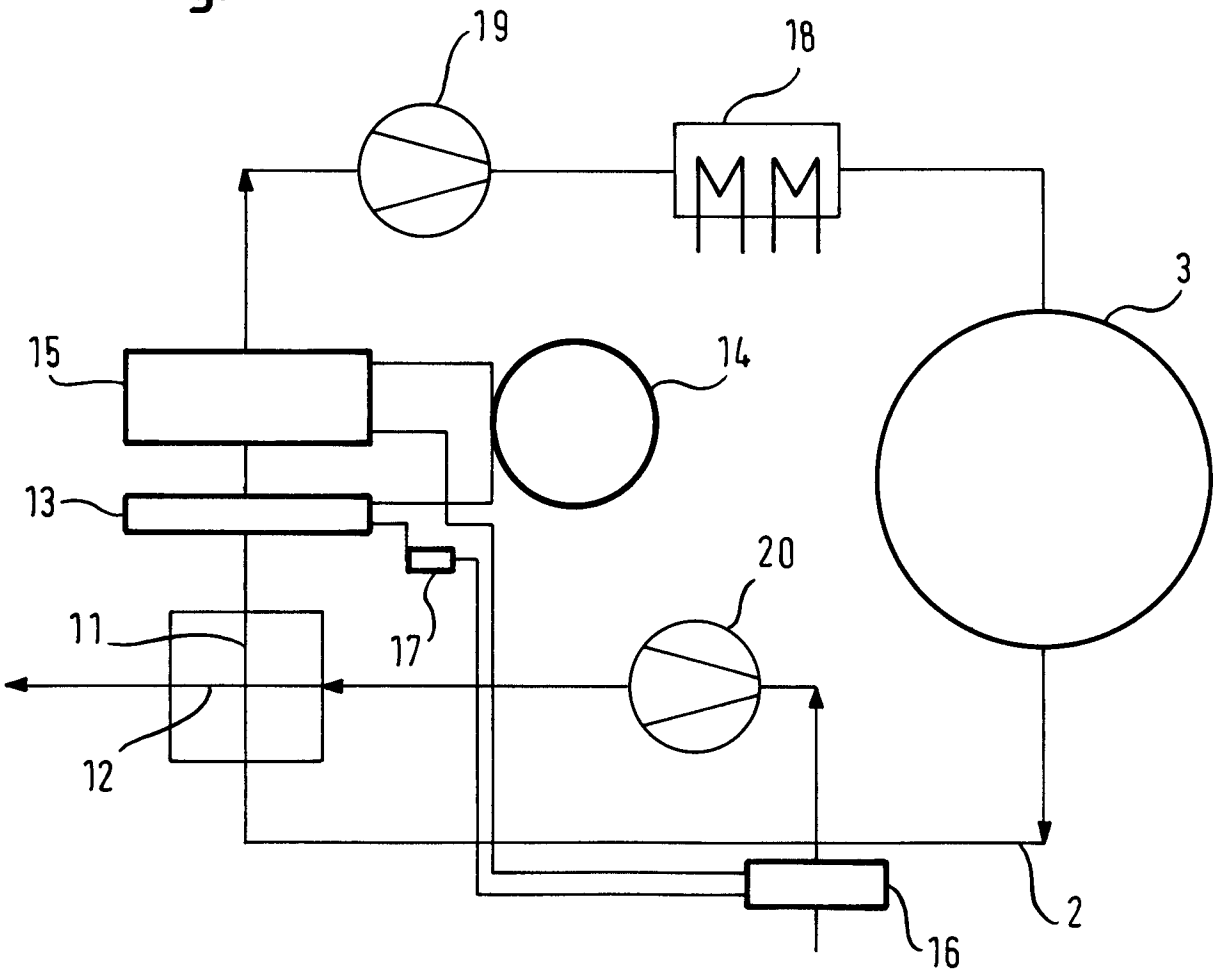
FIG. 4 shows a schematic representation of the process air circuit and of the heat pump circuit for a third embodiment of the condensation dryer.

FIG. 4 shows a schematic representation of the process air circuit and of the heat pump circuit for a third embodiment of the condensation dryer. With regard to this embodiment, the additional heat exchanger 16 functionally coupled with the air/air heat exchanger 11, 12 is arranged in the cooling air duct 12 on the side of the cooling blower 20 facing away from the air/air heat exchanger 11, 12. The heat exchanger 16 is thus located in the intake area for the cooling air.

Figure 5:
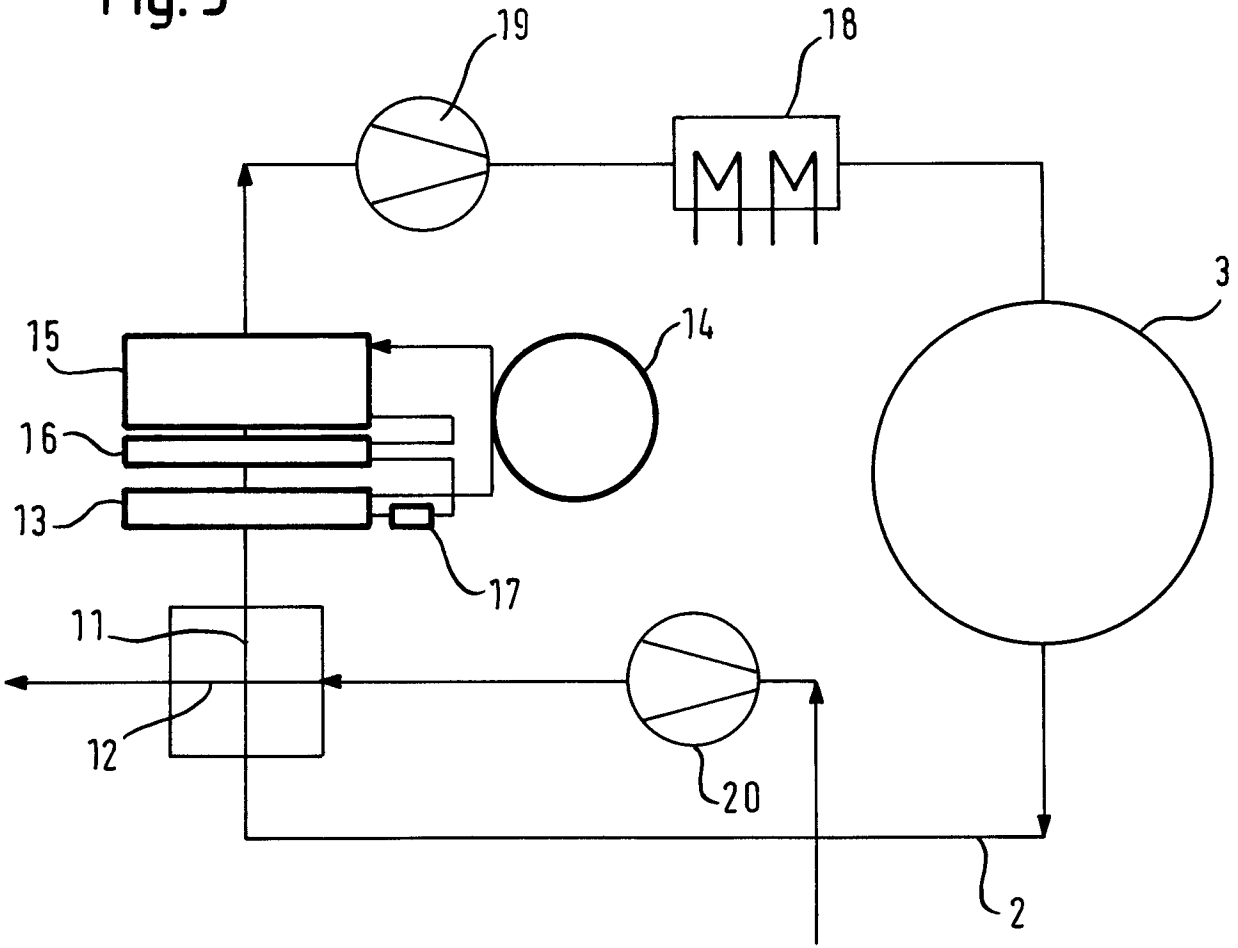
FIG. 5 shows a schematic representation of the process air circuit and of the heat pump circuit for a fourth embodiment of the condensation dryer.

FIG. 5 shows a schematic representation of the process air circuit and of the heat pump circuit for a fourth embodiment of the condensation dryer. With regard to this embodiment, the additional heat exchanger 16, which is functionally coupled with the air/air heat exchanger 11, 12, is arranged in the process air duct 11 between the relief valve 17, connected upstream of the evaporator 13, and the condenser 15. The exchange of heat thus takes place in the additional heat exchanger 16 between the liquid cooling agent and the relatively cool process air.

In the configuration according to FIG. 5, the additional heat exchanger 16 is not simply an extension of the condenser 15. In the condenser 15 the cooling agent is present in a two-phase mixture partly in the liquid phase and partly in the gaseous phase. A temperature is therefore reached which corresponds to the boiling temperature of the cooling agent at the given pressure in the condenser 15. A temperature lower than this cannot be achieved in the condenser 15. Increased or reduced delivery of heat into the condenser 15 is made up for without changing the temperature by a shift in the balance between the proportions of the liquid and the gaseous cooling agent in the two-phase mixture. However, if the liquid cooling agent is extracted pure from the two-phase mixture, then its temperature can be lowered if required by means of a further heat exchange and the liquid cooling agent can be subcooled by this means. Precisely this happens in the additional heat exchanger 16, which for this reason cannot be regarded as part of the condenser 15. However, the phenomenon of subcooling of the cooling agent occurring in this configuration offers an additional parameter for the design of the heat pump and of the temperature levels resulting in the latter, which results in additional scope for optimizing the operation of the heat pump and of the condensation dryer. It is possible to also implement and utilize this phenomenon and the scope resulting from it in other embodiments of the condensation dryer described here.

The invention claimed is:

1. A condensation dryer comprising:

a drying chamber, the drying chamber operable to retain articles to be dried;

a process air circuit, the process air circuit guiding process air along a path in which the process air is heated by a heater, moved across articles to be dried via a motive air source, guided through an air/air heat exchanger, and thereafter guided through a heat pump circuit formed of an evaporator, a compressor and a condenser, the heat pump circuit including a closed cooling agent circuit having a cooling agent circulating through the evaporator, the compressor, and the condenser; and an additional heat exchanger being part of the closed cooling agent circuit of the heat pump circuit, the additional heat exchanger being operatively coupled with the air/air heat exchanger and operatively coupled with the cooling agent of the closed cooling agent circuit of the heat pump circuit at a location in the heat pump circuit between the condenser and the evaporator of the heat pump circuit such that the additional heat exchanger exchanges heat between the cooling agent and one of the process air of the process air circuit and a cooling air of a cooling air duct of the air/air heat exchanger, wherein the additional heat exchanger is operatively coupled with the air/air heat exchanger at the cooling air duct of the air/air heat exchanger, and wherein the additional heat exchanger is operatively coupled with the air/air heat exchanger at the cooling air duct of the air/air heat exchanger at a location between a cooling blower and the air/air heat exchanger.

2. The condensation dryer as claimed in claim 1, wherein the cooling agent in the heat pump circuit is selected from the group which consists of a butane/isopropane mixture, carbon dioxide and a chlorofluorocarbon compound.

3. The condensation dryer as claimed in claim 1, wherein the air/air heat exchanger is removable.

4. A condensation dryer comprising:

a drying chamber, the drying chamber operable to retain articles to be dried;

a process air circuit, the process air circuit guiding process air along a path in which the process air is heated by a heater, moved across articles to be dried via a motive air source, guided through an air/air heat exchanger, and thereafter guided through a heat pump circuit formed of an evaporator, a compressor and a condenser, the heat pump circuit including a closed cooling agent circuit having a cooling agent circulating through the evaporator, the compressor, and the condenser; and an additional heat exchanger being part of the closed cooling agent circuit of the heat pump circuit, the additional heat exchanger being operatively coupled with the air/air heat exchanger and operatively coupled with the cooling agent of the closed cooling agent circuit of the heat pump circuit at a location in the heat pump circuit between the condenser and the evaporator of the heat pump circuit such that the additional heat exchanger exchanges heat between the cooling agent and one of the process air of the process air circuit and a cooling air of a cooling air duct of the air/air heat exchanger, wherein the additional heat exchanger is operatively coupled with the air/air heat exchanger at the cooling air duct of the air/air heat exchanger, and wherein the additional heat exchanger is operatively coupled with the air/air heat exchanger at the cooling air duct of the air/air heat exchanger on a side of the air/air heat exchanger facing away from a cooling blower.

5. The condensation dryer as claimed in claim 4, wherein the cooling agent in the heat pump circuit is selected from the group which consists of a butane/isopropane mixture, carbon dioxide and a chlorofluorocarbon compound.

6. The condensation dryer as claimed in claim 4, wherein the air/air heat exchanger is removable.

7. A condensation dryer comprising:

a drying chamber, the drying chamber operable to retain articles to be dried;

a process air circuit, the process air circuit guiding process air along a path in which the process air is heated by a heater, moved across articles to be dried via a motive air source, guided through an air/air heat exchanger, and thereafter guided through a heat pump circuit formed of an evaporator, a compressor and a condenser, the heat pump circuit including a closed cooling agent circuit having a cooling agent circulating through the evaporator, the compressor, and the condenser; and an additional heat exchanger being part of the closed cooling agent circuit of the heat pump circuit, the additional heat exchanger being operatively coupled with the air/air heat exchanger and operatively coupled with the cooling agent of the closed cooling agent circuit of the heat pump circuit at a location in the heat pump circuit between the condenser and the evaporator of the heat pump circuit such that the additional heat exchanger exchanges heat between the cooling agent and one of the process air of the process air circuit and a cooling air of a cooling air duct of the air/air heat exchanger, wherein the additional heat exchanger is operatively coupled with the air/air heat exchanger at the cooling air duct of the air/air heat exchanger, and wherein the additional heat exchanger is operatively coupled with the air/air heat exchanger at the cooling air duct of the air/air heat exchanger on a side of a cooling blower facing away from the air/air heat exchanger.

8. The condensation dryer as claimed in claim 7, wherein the cooling agent in the heat pump circuit is selected from the group which consists of a butane/isopropane mixture, carbon dioxide and a chlorofluorocarbon compound.

9. The condensation dryer as claimed in claim 7, wherein the air/air heat exchanger is removable.

* * * * *